US005778868A

United States Patent [19]

Shepherd

[11] Patent Number: 5,778,868

[45] Date of Patent: Jul. 14, 1998

[54] PNEUMATIC GUN

[75] Inventor: Charles G. Shepherd, Oakville, Canada

[73] Assignee: K.K.M. Inc., Mississauga, Canada

[21] Appl. No.: 794,707

[22] Filed: Feb. 3, 1997

[51] Int. Cl.[6] ..... F41B 11/32

[52] U.S. Cl. ..... 124/76; 124/73

[58] Field of Search ..... 124/56, 70, 71, 124/73, 74, 76

[56] References Cited

U.S. PATENT DOCUMENTS

| | | | |
|---|---|---|---|
| 3,921,614 | 11/1975 | Fogelgren | 124/75 |
| 4,936,282 | 6/1990 | Dobbins et al. | 124/74 |
| 5,063,905 | 12/1991 | Farrell | 124/72 |
| 5,078,118 | 1/1992 | Perrone | 124/74 |
| 5,228,427 | 7/1993 | Gardner, Jr. | 124/71 |
| 5,257,614 | 11/1993 | Sullivan | 124/73 |
| 5,280,778 | 1/1994 | Kotsiopoulos | 124/73 |
| 5,333,594 | 8/1994 | Robinson | 124/73 |
| 5,339,791 | 8/1994 | Sullivan | 124/73 |
| 5,349,939 | 9/1994 | Perrone | 124/76 |
| 5,363,834 | 11/1994 | Stuchlik | 124/76 |
| 5,383,442 | 1/1995 | Tippmann | 124/76 |

*Primary Examiner*—John A. Ricci
*Attorney, Agent, or Firm*—Rogers & Scott

[57] ABSTRACT

According to the invention a firing mechanism is provided for use in semi-automatic guns of the type which use compressed gas to fire projectiles from a gun barrel. The mechanism has an inlet valve to receive the gas and an automatic outlet valve connected pneumatically to the inlet valve. A compound valve element is biased to move longitudinally from a first position where it is ready for firing to a second position. When the mechanism is actuated the valve element moves to the second position and gas flows from the inlet valve into a gas chamber in the outlet valve. When the gas reaches a selected pressure the valve element is driven back towards the first position before the gas is free to fire a projectile. This ensures that sufficient force is available to recock the gun and that the gas pressure available to drive the projectile is generally constant thereby controlling the muzzle velocity of the projectile.

17 Claims, 2 Drawing Sheets

PNEUMATIC GUN

FIELD OF THE INVENTION

This invention relates to firing mechanisms and more particularly to such mechanisms used in semi-automatic pneumatic guns of the type used to fire marking pellets, also known as paint balls, as well as for firing projectiles such as darts, metallic pellets or BBs.

BACKGROUND OF THE INVENTION

The invention will be described with reference to its use in guns designed to fire paint balls, but it will be appreciated that the characteristics of the invention make it suitable for other uses.

Pneumatic guns are designed to be operated from a source of pressurized gas such as that found in canisters containing gas in a liquid state. The efficiency of the firing mechanism is measured in terms of the amount of gas used to fire a projectile so that a gun having a low efficiency will fire fewer effective shots for a given volume of gas than will a gun with a higher efficiency. This also becomes a factor when the gun is used to fire projectiles in quick succession. Inefficient guns will use a higher volume of gas over a short period of time, with the resulting tendency for the temperature in the gas canister to drop thereby causing a loss in gas pressure. For these reasons (as well as the cost of the gas) it is desirable to use as little gas as possible to propel a projectile.

Another characteristic of pneumatic guns is that there is a natural variation in pressure available from the gas canister as the gas is used up. Initially the pressure tends to be high and falls towards a lower pressure as the gas is exhausted. Similarly the pressure will be affected by fluctuations in ambient temperature.

An ideal arrangement would be such that the pressure and volume of gas available to fire the projectile is constant for every shot and the volume of gas used with each shot is kept to a minimum. It is also desirable to keep the muzzle velocity within acceptable limits.

An example of a semi-automatic firing mechanism is found in U.S. Pat. No. 3,921,614 to Fogelgren. In this structure, pressure from a gas canister is applied to the mechanism to fill a chamber. As the pressure builds up in the chamber, a point is reached where the chamber causes closure of a valve to prevent further introduction of gas. The gun remains in this condition until actuated at which point the gas in the chamber is allowed to exhaust into the barrel to fire a projectile. The reduction in pressure in the chamber allows a return spring to open the inlet valve and refill the chamber with gas to the point where a predetermined pressure is reached dictated by the spring. The gun is then ready to fire another projectile.

The mechanism shown in U.S. Pat. No. 3,921,614 has the advantage that the pressure introduced into the mechanism is naturally limited by closure of a valve as the gas meets a predetermined pressure in the mechanism. However, the structure tends to be somewhat complicated. Also, because the gun is recocked by new gas entering the gun after firing, there must be a time delay during which a user could prematurely operate the firing mechanism. If this is done, the gun would not operate satisfactorily. Clearly, it would be preferable if the timing were such that the gun is naturally recocked prior to firing the next projectile.

U.S. Pat. No. 5,063,905 to Farrell illustrates a type of mechanism that has become quite common in the art. In this case, gas is released when a striker is caused to move under the influence of a spring to hit a valve momentarily. The time during which the valve is open is sufficient to allow gas to enter a chamber to both fire the projectile and to recock the striker. Structures of this kind suffer from a major disadvantage. The gas pressure in entering the chamber is not regulated in any way and consequently the amount of gas that escapes after impact by the striker will vary both with the pressure in the canister and with the spring setting. This problem will be noticed for instance if the gun is adjusted to give a selected muzzle velocity in a cold condition and then the gun is warmed. The muzzle velocity will increase significantly and may become hazardous.

A further approach to firing mechanisms for pneumatic systems is found in U.S. Pat. No. 5,280,778 to Kotsiopoulos. The structure shown in this patent includes a structure described as a pressure regulator which receives gas from a canister to set the pressure at which the gas enters the firing mechanism. This mechanism is then used somewhat conventionally to fire a projectile. However, the system is not capable of producing accurate pressure regulation due to the fact that the regulator operates by applying gas pressure to both sides of a piston element and the resulting pressure is a differential caused by the difference in the areas at the ends of the piston element. Clearly, if the pressure drops in the canister, then the resulting pressure in the gun will also drop. This, in turn, leads to decreased muzzle speed with consequent inconsistent firing results. Nevertheless, the gun controls the pressure to some extent and is an improvement over other devices.

It is an object of the present invention to provide a firing mechanism for use in pneumatic guns which is capable of semi-automatic use and which will also operate at a threshold pressure which can be varied. The threshold pressure will dictate the muzzle velocity and maintain a more constant result as long as the pressure in the gas canister remains above the threshold pressure.

SUMMARY OF THE INVENTION

According to the invention a firing mechanism is provided for use in semi-automatic guns of the type which use compressed gas to fire projectiles from a gun barrel. The mechanism has an inlet valve to receive the gas and an automatic outlet valve connected pneumatically to the inlet valve. A compound valve element is biased to move longitudinally from a first position where it is ready for firing to a second position. When the mechanism is actuated the valve element moves to the second position and gas flows from the inlet valve into a gas chamber in the outlet valve. When the gas reaches a selected pressure the valve element is driven back towards the first position before the gas is free to fire a projectile. This ensures that sufficient force is available to recock the gun and that the gas pressure available to drive the projectile is generally constant thereby controlling the muzzle velocity of the projectile.

BRIEF DESCRIPTION OF THE DRAWINGS

The invention will be better understood with reference to the following description and accompanying drawings, in which.

Figures 1, 2:
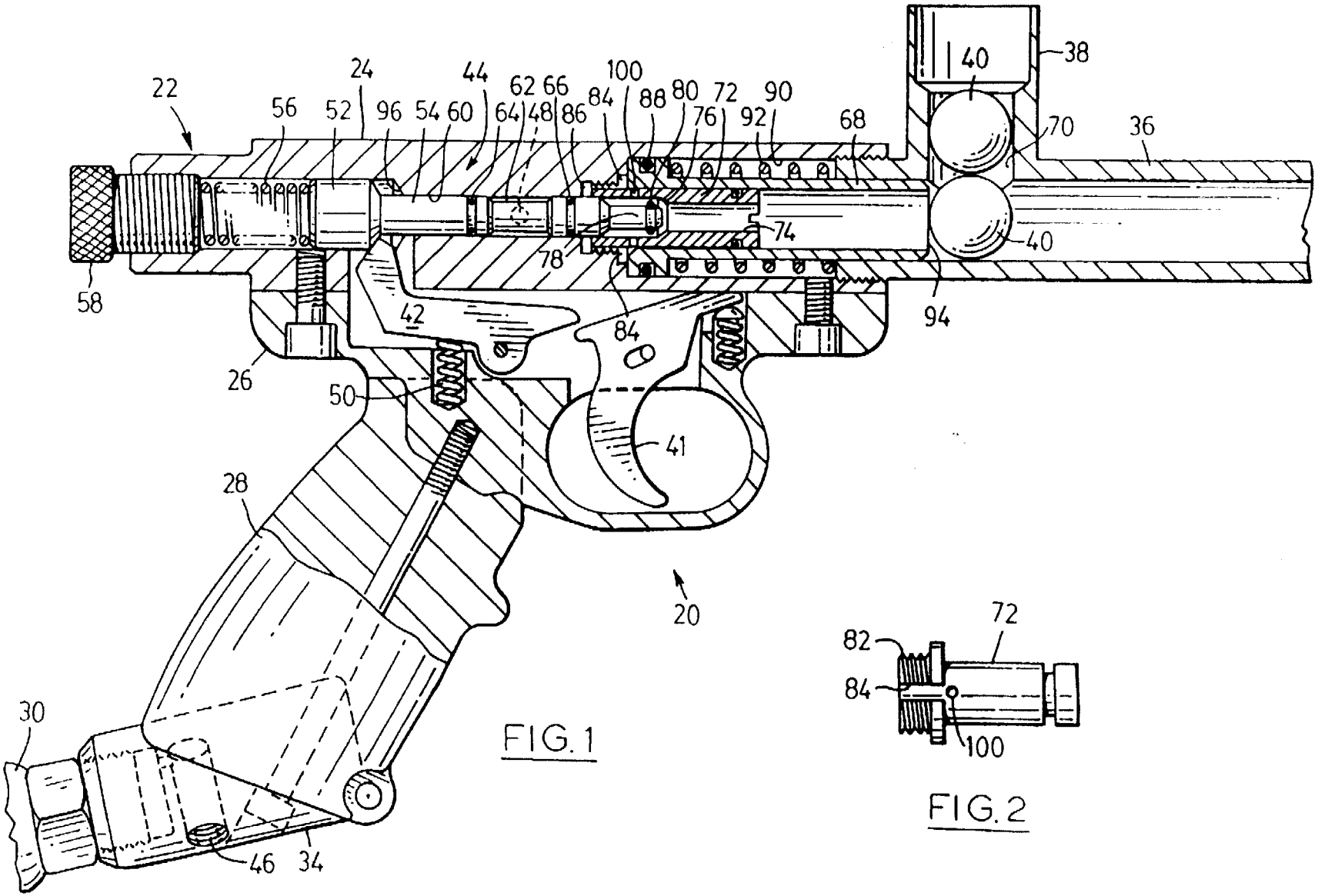
FIG. 1 is a sectional side view of an exemplary paint ball gun incorporating a firing mechanism according to the invention and showing the mechanism in a cocked condition ready to fire a paint ball.
FIG. 2 is a side view of an element of the firing mechanism.

Reference is first made to FIG. 1 which illustrates an exemplary paint ball gun designated generally by the numeral 20 and consisting essentially of a frame 22 having a main body 24 and actuator assembly 26 which is connected to a handle 28. A high pressure gas canister 30 (part of which is shown) is releasably connected to a coupling assembly 34 at the base of the handle 28, and the gun also includes a barrel 36 attached to the body 24, and having associated with it a magazine 38 for supplying paint balls 40.

A firing mechanism 44 of the gun is operated when the user pulls a trigger 41 forming part of the actuator assembly 26 to rotate a sear 42 thereby releasing the firing mechanism 44.

The firing mechanism 44 will be described with reference to the operation of the mechanism to better understand the parts of the mechanism. As mentioned, gas is supplied from a canister 30 and is coupled to the firing mechanism 44 by an external high pressure hose (not shown) which is connected between an outlet port 46 adjacent the canister 30 and an inlet port 48 in the body 24 and leading to the mechanism 44.

In the condition shown, the sear 42 is biased by a compression spring 50 to retain its position in engagement with an enlarged head 52 of a generally cylindrical compound valve element 54 which extends axially in alignment with the barrel 36. The head 52 is in engagement with an axial compression spring 56 which, at its other end, is retained by a threaded adjuster 58. This adjuster is engaged in the body so that rotating it will change the length of the spring, thereby changing the energy stored in the spring 56. To this point it is sufficient to understand that the spring 56 is urging the valve element 54 to move longitudinally from a first position shown in FIG. 1 to a second position shown in FIG. 3. This biasing is resisted by the sear 42 until such time as trigger 41 is operated to rotate the sear thereby and releasing the element 54 and allowing the spring 56 to move the element towards the paint ball 40.

As mentioned previously, gas from canister 30 enters the firing mechanism at a port 48. This port leads to a bore 60 in the body 24 which contains an elongate portion of the valve element 54 having an annular recess 62. The bore 60 and recess 62 combine to define an annular chamber contained in the bore between annular gas seals 64, 66. Full pressure from the canister 30 is available between these seals in a limited volume defined by the annular chamber defined by the recess 62.

It will be evident that the gas entering port 48 effectively meets an inlet valve which prevents further entry of the gas with the firing mechanism in the position shown in FIG. 1. The valve is shown in a closed position, and as will be described the valve is biased by spring 56 into an open position.

As shown in FIG. 1, the gun is in condition to be fired. There is limited entry of gas and full line pressure of the gas is available. To fire the gun, this gas will be used in three ways. First of all, a tubular bolt 68 will be moved from a stored position shown in FIG. 1 to a deployed position (shown in FIG. 3) to move the paint ball 40 past an outlet passage 70 of the magazine 38 to ensure that no gas is lost into the magazine. Secondly, the gas will start to recock the gun back into the condition shown in FIG. 1 ready for further firing, and then the gas will complete the cocking action while firing the paint ball through the barrel 36.

It has been conventional either to fire the ball and then recock the mechanism, or to attempt to fire the ball and cock the mechanism simultaneously. By contrast, the present mechanism first initiates cocking and then fires the ball thereby using maximum gas pressure to start the cocking action. This will become evident from the following description.

As seen in FIG. 1, a leading end portion of the valve element 54 is engaged in a cylindrical tubular element 72 which can also be seen in FIG. 2. This element is threadably fixed in the body 24 and defines a continuation of the bore 60. However, the element 72 also defines a bore 74 of reduced diameter which meets the larger bore at a tapered entry 76. An end portion 78 of the valve element 54 is of reduced diameter and carries a seal 80 proportioned to enter and seal in the bore 74, guided by the taper and entry 76.

As better seen in FIG. 2, the element 72 has a threaded portion 82 interrupted by a series of slots 84 (one of which is shown) so that gas can pass through the slots 84 when the element is in place in the body. These slots are in communication with a radial cavity 86 so that when gas enters this cavity, it can pass through the slots 84 and engage an enlarged end of the bolt 68 which carries a seal 88 and slides in a cylindrical opening 90 in the body 24. The enlarged end meets a light compression spring 92 which is trapped between the barrel 36 and the enlarged end of the bolt 68. The barrel 36 is threaded into the body 24. Consequently, the bolt 68 is normally biased to the left of FIG. 1 and sits in a position where an outer end 94 of the bolt is aligned with the outlet passage 70 to allow a paint ball 40 to fall into the position shown.

Figure 3:
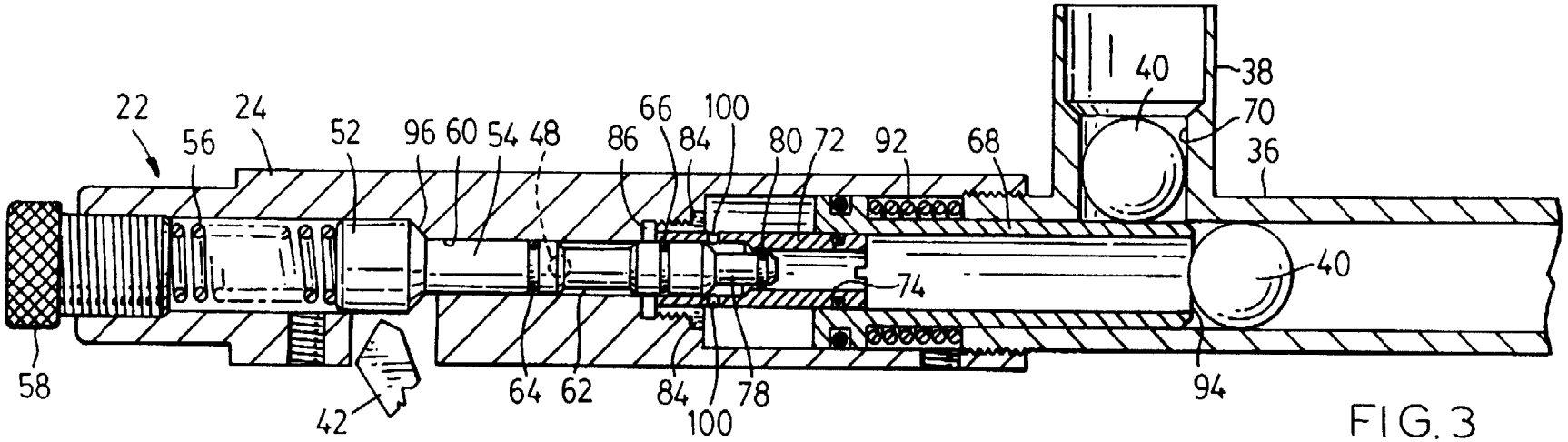
FIG. 3 is a view similar to FIG. 1 and showing the firing mechanism after release by an actuator.

Reference is next made to FIG. 3 which illustrates the first step in the operation of the firing mechanism when the user pulls the trigger 41. As seen in FIG. 3, the sear 42 has been moved downwardly to release the head 52 which as a result has moved to the right under the influence of the spring 56. This carries the compound valve element 54 longitudinally along the bore 60 from the first position to the second position where the head 52 meets a shoulder 96 in the body 24 to stop any further movement. At this point, the seal 64 in the inlet valve has approached the port 48 but has not passed the port. The inlet valve therefore continues to function to prevent gas flow to the left through the bore 60, but because the seal 66 has passed the radial cavity 86, line pressure gas will enter this cavity. The gas then passes through the slots 84 (FIG. 2) of the element 72 to engage the enlarged end of the bolt 68 which moves to the right until spring 92 is fully compressed. At this point the bolt has closed off the outlet passage 70 of the magazine 38. In doing so the bolt pushes the paint ball 40 along the barrel 36 into a new position where it can be retained using a nubbins or other suitable device as is common in the art.

When the gas is available to move bolt 68 to the right, the gas also passes through radial openings 100 in the cylindrical tubular element 72 and into a chamber formed about the end portion 78 of the compound valve element 54. This end portion is of smaller diameter than the adjacent main portion of the valve element and terminates with a seal 102 engaged in the smaller bore 74 of the element 72. Consequently, the gas pressure acting on the valve element will cause the valve element to move to the left because of the different diameters and resulting annular areas exposed to the gas. This is effectively an automatic outlet valve which is closed with the valve element 54 in the second position (to the right) once the gas enters through the opening 100, the pressure will begin to build and when it creates a force sufficient to overcome the energy stored in the compression spring 56, the valve element 54 will be accelerated to the left (back towards said first position) by the increasing gas pressure thereby opening the automatic outlet valve. Effectively this action takes place at a threshold pressure, although the pressure will build up slightly beyond this pressure while the valve element moves towards a position to stop further flow. This increasing pressure can continue for a very short time only because the seal 102 is moving to the left and will communicate with the openings 100 allowing the gas to pass through the bore 74 before meeting the paint ball 40 and firing the paint ball through the barrel 36.

Figure 4:
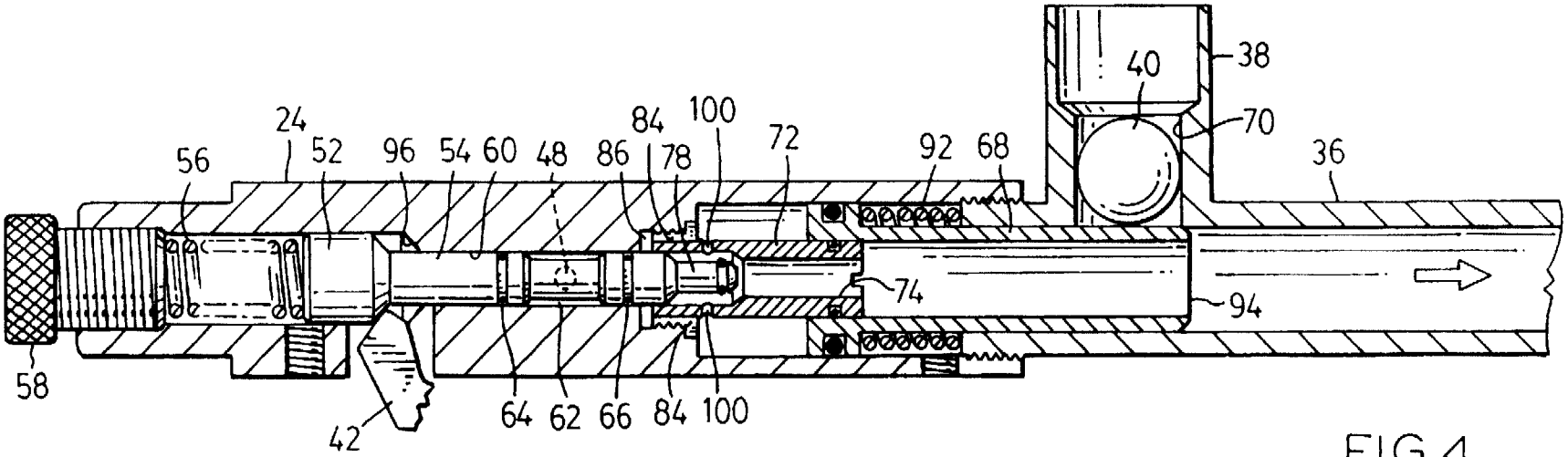
FIG. 4 is a view similar to FIG. 3 and showing the firing mechanism at the stage when the mechanism has been recocked and the paint ball has been fired.

As the automatic outlet valve operates, the compound valve element 54 moves to the left of FIG. 3 and carries with it the seal 66 into the bore 60 of the body 24. This movement closes the inlet valve and prevents further gas flow into the mechanism. The resulting position is shown in FIG. 4 where it will be seen that the paint ball has been fired and the compound valve element 54 has been reset. There will be some pressure holding the bolt 68 and this pressure is exhausted through the radial openings 100, bore 74, and the barrel 36. As a result the light spring 92 will return the bolt 68 to the FIG. 1 position and the next paint ball will pass from the magazine 38 into the barrel 36.

It will also be seen in FIG. 4 that because the compound valve element 54 has returned to its original position, the sear 42 has returned under the influence of spring 50 into engagement with the head 52 of the valve element to complete the "recocking" of the firing mechanism.

An important consideration of the firing mechanism shown in accordance with the present invention is the fact that the recocking action is started before the paint ball is fired. As a result, full gas pressure is available to overcome the load on the spring 56 to initially accelerate the valve element 54. This arrangement sets the threshold for the gas pressure because as soon as the pressure is sufficient to create a load greater than the spring force, the movement will start and the inlet valve will quickly prevent further ingress of gas. Firing then takes place using the gas that is already in the system at or close to the threshold pressure. The result is that the paint ball is fired with a more consistent muzzle velocity.

It will be clear that the firing mechanism can be manufactured from conventional materials using suitable tolerancing to provide gas seals used to permit relative movement between parts to facilitate firing and recocking.

Also, the firing mechanism can be varied by changing the proportions and arrangement of the parts consistent with providing structure acting as an inlet valve and structure operating as an automatic outlet valve which acts to first start recocking the mechanism before providing gas pressure to fire a projectile.

All such variations are within the scope of the invention as described and claimed.

I claim:

1. A firing mechanism for use in semi-automatic guns of the type which use compressed gas to fire projectiles from a gun barrel, the firing mechanism having:

a main body including a gas supply port;

an actuator coupled to the main body and operable to operate the firing mechanism and including a trigger and sear;

a slidably-mounted compound valve element movable longitudinally between a first position and a second position;

an adjustable compression spring contained in the body and in engagement with the valve element, the spring biasing the valve element to move from the first to the second position, the sear normally retaining the valve element in said first position;

an inlet valve in the main body coupled to the valve element, the inlet valve being closed with the valve element in said first position and open with the valve element in said second position;

an automatic outlet valve in the main body coupled to the compound valve element, the outlet valve being open with the valve element in said first position and closed with the valve element in said second position, the automatic outlet valve having a gas chamber including an inlet for receiving gas from the inlet valve and an outlet through which gas passes to enter the gun barrel; and whereby compressed gas entering the firing mechanism is available at the closed inlet valve and, upon operating the actuating mechanism, the sear releases the compound valve element which moves into said second position, thereby releasing gas from the inlet valve into said gas chamber to a threshold pressure whereupon the compound valve element is driven from said second position towards said first position, overcoming the energy stored in the compression spring so that the outlet valve then opens to provide gas to fire a projectile from the barrel and the inlet valve recloses as the valve element returns to said first position and the sear again retains the valve element in said first position ready for another actuation.

2. A firing mechanism as claimed in claim 1 in which the compound valve element moves along a longitudinal axis and includes a cylindrical head, the compression spring being disposed about said axis and in contact with said head.

3. A firing mechanism as claimed in claim 2 in which the main body defines a shoulder providing a stop for engagement by the head of the compound valve element to stop the valve element in said second position.

4. A firing mechanism as claimed in claim 2 and further having a tubular bolt slidable in the barrel and a magazine for delivering projectiles into the barrel, the magazine meeting the barrel at an outlet passage and the bolt being movable between a stored position clear of the outlet passage and a deployed position where the bolt reduces gas flow from the barrel into the outlet passage.

5. A firing mechanism as claimed in claim 4 and further having a compression spring positioned about the tubular bolt and biasing the bolt towards the stored position.

6. A firing mechanism as claimed in claim 5 in which the bolt is located in the pneumatic connection between the inlet valve and the automatic outlet valve so that, on actuating the mechanism, gas pressure will move the bolt into the actuated position.

7. A firing mechanism as claimed in claim 1 in which the gas chamber in the outlet valve has an outlet and in which the valve element has an end portion which closes the outlet with the valve element in the second position, and in which the end portion is of reduced diameter so that pressure on the valve element in the gas chamber creates an axial load on the valve element to drive the element towards said first position and the end portion of the element then leaves the outlet of the gas chamber to permit gas into the barrel to fire the projectile.

8. A firing mechanism as claimed in claim 1 and further having an adjuster coupled to the body and in engagement with the compression spring for varying the length of the spring to thereby adjust said threshold pressure so that the muzzle velocity meets a measured standard.

9. A firing mechanism for use in semi-automatic guns of the type used to fire projectiles from a barrel using compressed gas stored in a high pressure canister, the firing mechanism having;

a main body;

an inlet valve in the main body and adapted to receive gas from the gas canister of a pressure above a selected threshold pressure;

an automatic outlet valve in the body and coupled pneumatically to the inlet valve; the outlet valve including a gas chamber for receiving gas from the inlet valve and having an outlet leading to the barrel;

a compound valve element movable longitudinally and coupled to both the inlet valve and the outlet valve and biased upon firing the gun to open the inlet valve and close the outlet in the gas chamber, the valve element being shaped to respond sequentially to threshold pressure in the gas chamber to first overcome the bias on the element to move the element to close the inlet valve and to then open the outlet in the outlet valve to release gas into the barrel.

10. A firing mechanism as claimed in claim 9 in which the compound valve element moves along a longitudinal axis and includes a cylindrical head, and in which the mechanism further includes a compression spring disposed about said axis and in contact with said head.

11. A firing mechanism as claimed in claim 10 in which the main body defines a shoulder providing a stop for engagement by the head of the compound valve element to resist the biasing force of the spring with said outlet from the gas chamber closed.

12. A firing mechanism as claimed in claim 10 and further having a tubular bolt slidable in the barrel and a magazine for delivering projectiles into the barrel, the magazine meeting the barrel at an outlet passage and the bolt being movable between a stored position clear of the outlet passage and a deployed position where the bolt reduces gas flow from the barrel into the outlet passage.

13. A firing mechanism as claimed in claim 12 and further having a compression spring positioned about the tubular bolt and biasing the bolt towards the stored position.

14. A firing mechanism as claimed in claim 13 in which the bolt is located pneumatically between the inlet valve and the automatic outlet valve so that, on actuating the mechanism, gas pressure will move the bolt into the actuated position.

15. A firing mechanism as claimed in claim 9 in which the mechanism further includes a compression spring positioned in engagement with the compound valve element to provide said biasing of the compound valve element.

16. A firing mechanism as claimed in claim 15 and further having an adjuster coupled to the body and in engagement with the compression spring for varying the length of the spring to thereby adjust said threshold pressure so that the muzzle velocity meets a measured standard.

17. In a semi-automatic gun having an inlet valve for receiving pressurised gas from a gas supply to provide gas discharge on actuating the gun to fire a projectile from a barrel, and an outlet valve having a gas chamber for receiving gas to both recock the gun and fire the projectile, the improvement in which the gun includes a compound valve element movable longitudinally and coupling the inlet valve and the outlet valve, and a gas chamber having an outlet closed by engagement with the valve element on actuating the gun so that gas entering the gas chamber reaches a threshold pressure, the valve element being shaped to respond to the threshold pressure to initially commence cocking the gun thereby moving the valve element longitudinally so that the gas escapes through the outlet of the gas chamber to release the gas into the barrel to fire the projectile after recocking commences.

* * * * *